US005921535A

United States Patent [19]

Lutz, III

[11] Patent Number: 5,921,535

[45] Date of Patent: Jul. 13, 1999

[54] TOGGLE CLAMP

[75] Inventor: Peter J. Lutz, III, Macomb, Mich.

[73] Assignee: E&E Engineering, Inc., Warren, Mich.

[21] Appl. No.: 08/902,972

[22] Filed: Jul. 30, 1997

[51] Int. Cl.[6] ..... B25B 1/14

[52] U.S. Cl. ..... 269/228

[58] Field of Search ..... 269/228, 237, 269/238, 201

[56] References Cited

U.S. PATENT DOCUMENTS

| | | | |
|---|---|---|---|
| 1,997,428 | 4/1935 | Olson | 269/228 |
| 2,327,368 | 8/1943 | Olson . | |
| 2,577,029 | 12/1951 | Moorehead | 269/228 |
| 3,391,635 | 7/1968 | Matheus | 269/228 |
| 4,108,589 | 8/1978 | Bunch . | |
| 5,435,533 | 7/1995 | Weinmann, Jr. . | |

*Primary Examiner*—Robert C. Watson

*Attorney, Agent, or Firm*—Gifford, Krass, Groh, Sprinkle, Anderson & Citkowski, P.C.

[57] ABSTRACT

This invention relates generally to a manual toggle clamp for use in fixturing. The clamp includes an operating arm that is pivotally supported on a support block and a pair of outboard clamping links which share a common pivot axis and are supported on the support block. A pair of intermediate links interconnect the operating arm and the clamping links such that movement of the operating arm causes the clamping links to rotate. The elements of the clamp are configured such that they form an over-center linkage which prevents the clamping links from being moved out of a clamping position except by movement of the operating arm. The outboard clamping links provide a mounting surface for one or more clamping arms of the type typically used with power clamps.

10 Claims, 2 Drawing Sheets

TOGGLE CLAMP

FIELD OF THE INVENTION

This invention relates generally to clamping devices and more specifically to toggle clamps for use in fixturing.

BACKGROUND OF THE INVENTION

Many manufacturing facilities and machine shops use fixtures to hold workpieces such as metal stock in a particular position. The fixture accurately locates the workpieces so that other materials may be positioned relative to them or so that machining operations can be performed on the workpieces. A fixture typically includes one or more clamps for selectively retaining a workpiece. A workpiece is positioned in the fixture and then the clamps are engaged to lock the workpiece in place.

Clamps for use with fixtures are generally of two types: manual clamps and power clamps. A manual clamp is designed to be hand operated and includes an operating arm, a mechanical linkage, and a clamping arm. When the operating arm is moved by hand, the linkage mechanism forces the clamping arm to move between an open and a clamped position. Different types and configurations of clamping arms are required depending upon the application for the clamp. A manual clamp may be used for prototyping or small scale production, but for larger scale production a power clamp is preferred. A power clamp is a device which uses hydraulic or electrical power to operate a clamping arm and clamp a workpiece in place. Power clamps are expensive and must be securely mounted on the fixture to properly perform their function. In addition, their operation requires power connections, controllers and the like. During the design and prototyping of a fixture, it is desirable to use a less expensive, simpler to install and reposition hand operated, mechanical clamp to optimize the configuration of the fixture. Toggle clamps such as those provided by Carr Lane Manufacturing Company of St. Louis, Mo., are an example of a manually operated clamp that can be used during the design stage of a fixture. The use of a manual toggle clamp during the prototyping stages allows the fixture designer to more easily adjust the number and position of clamps; and thereafter, power clamps are usually substituted for the manual clamps.

Prior art toggle clamps do not mount to a fixture in the same way that a power clamp does. This prevents direct substitution of a power clamp for a manual toggle clamp once the fixture design is complete. Therefore, when the fixture designer is ready to install the power clamps he or she must remove the mechanical clamp, attach a new mounting bracket for the power clamp, and then install the power clamp. The fixture designer runs the risk that the positioning of the power clamp will not be identical to the positioning of the manual clamp due to the lack of direct substitution. Therefore, there is a need for a manually operated toggle clamp which is configured to be directly substitutable for a power clamp. This allows a fixture designer to use a mechanical clamp to design and test a fixture and then to substitute a power clamp for each toggle clamp without any concerns about changes in the relative position of the fixture and clamp.

Prior art manual clamps also differ from powered clamps in how the clamping arm connects to the remainder of the clamp. A power clamp generally has a body with clamping links on each outboard side of the body. Various configurations of clamping arms can be attached to these outboard attachment areas. Prior art manual clamps do not have outboard attachments but instead have one central clamping arm that is integral to the clamp. Therefore, the clamping arm on a manual clamp is of fixed configuration and cannot be removed for use with a power clamp. Even if the arm of a manual clamp were removable, attaching it to the outboard clamping link on a power clamp would reposition the clamping arm relative to the workpiece.

Thus, there is a need for a manual clamp that is directly substitutable for a power clamp, since it would allow a fixture designer to finalize fixture design and clamping arm configuration while using a manual clamp and then directly substitute a power clamp. It is also desirable that the clamping arm from the manual clamp be capable of being removed and connected to the outboard links on the power clamp. Therefore, there is a need for a mechanical toggle clamp that includes outboard clamping links corresponding to the clamping links of power clamps.

SUMMARY OF THE INVENTION

There is disclosed herein a toggle clamp for use in fixturing. The toggle clamp includes a support block and an operating arm which has a first end which is pivotally supported by the support block through a support axis so that the operating arm is pivotable from a first position to a second position. The toggle clamp also includes a first and a second intermediate link which are each pivotally attached to opposite sides of the operating arm through an attachment axis so that the operating arm is disposed between the first and second intermediate links. The toggle clamp also includes a first and a second clamping link. Each clamping link is pivotally supported on the support block through a first pivot axis and is also pivotally connected to a respective one of the intermediate links through a second pivot axis. The toggle clamp is configured so that the support axis, the attachment axis, and the second pivot axis are not in mutual linear alignment when the operating arm is in the first position or in the second position. However, the support axis, the attachment axis, and the second pivot axis are in mutual linear alignment when the operating arm is at a third position between the first and second positions. Some embodiments of the toggle clamp include a clamping arm which is supported by at least one of the clamping links.

DETAILED DESCRIPTION OF THE DRAWINGS

Figure 1:
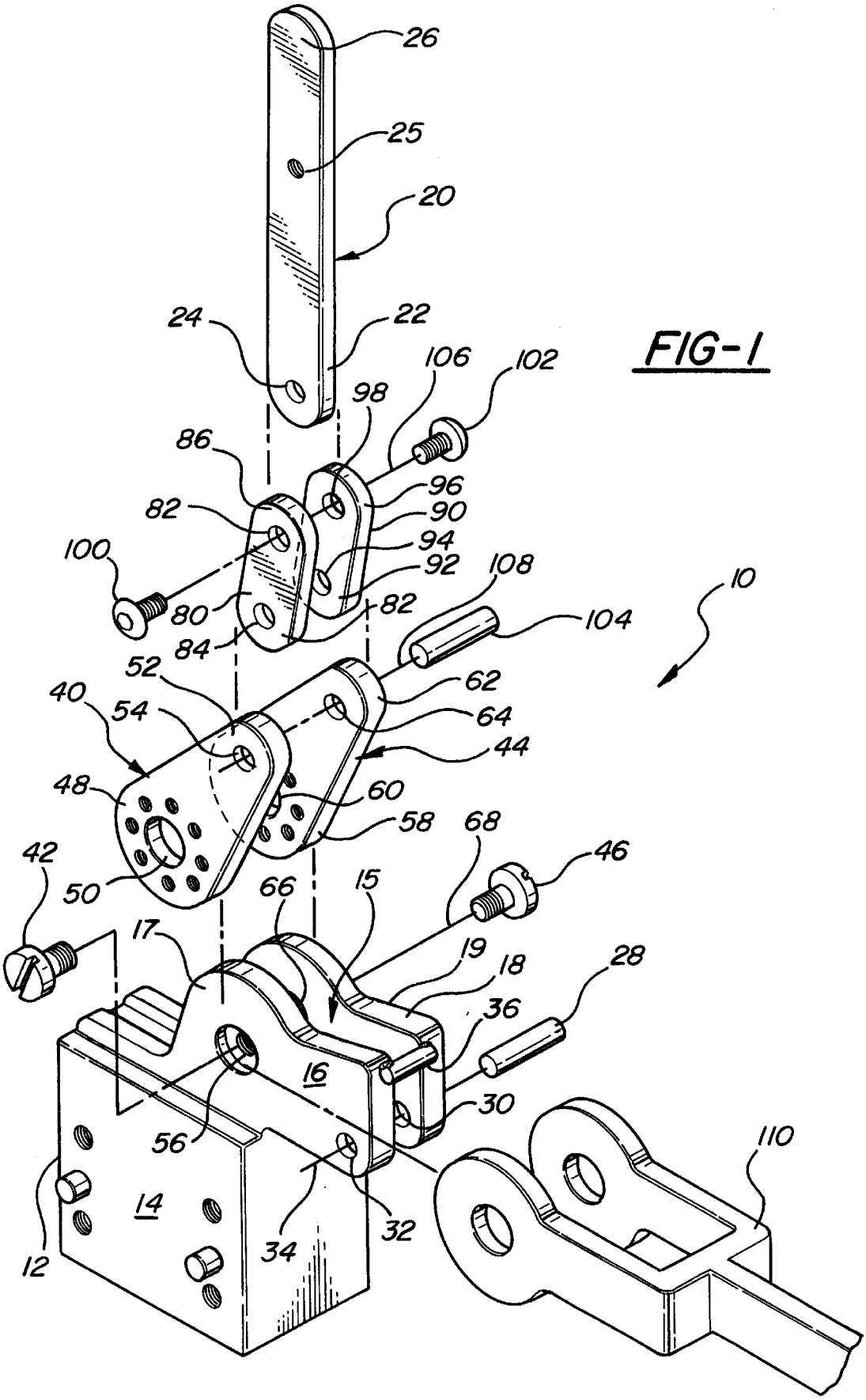
FIG. 1 is an exploded perspective view of a toggle clamp according to the present invention.

Referring to the figures, in which like numbers refer to the same part throughout, a toggle clamp according to the present invention is generally shown at 10. The toggle clamp 10 includes a support block 12 having a lower portion 14 for affixing the toggle clamp to a fixture (not shown); toward that end, the support block 12 may be provided with tapped holes, connector pins, welding flanges or the like. As illustrated, the support block 12 further includes a first support flange 16, and a second support flange 18. The support flanges 16 and 18 extend upwardly from the lower portion 14 and are parallel and spaced apart from each other. The area between the first and second support flanges 16 and 18 defines an inner region 15. The side of first support flange 16 opposite the inner region 15 is defined as an outside surface 17. The surface of the second support flange 18 opposite the inner region 15 is defined as an outside surface 19 of the support flange 18.

The clamp further includes an operating arm 20, having a first end 22 with a hole 24 defined therethrough and a second end 26. An intermediate connection hole 25 is located between the first end 22 and the second end 26. The operating arm 20 is pivotally supported between the support flanges 16 and 18 of the support block 12 by a dowel pin 28, which passes through a first hole 30 in the second support flange 18, through the hole 24 in the operating arm 20, and then through a first hole 32 defined through the first support flange 16. The dowel pin 28 defines a support axis 34 about which the operating arm 20 pivots. The range of movement of the operating arm 20 is limited by interference with the lower portion 14 of the support block 12 at one extreme of motion and by a stop 36, interconnecting flanges 16 and 18, at the other extreme of motion.

A first clamping link 40 is pivotally supported adjacent the outside surface 17 of first support flange 16 by a first connector which in this instance is a threaded bolt 42. A second clamping link 44 is pivotally supported adjacent the outside surface 19 of the second support flange 18 by a second bolt 46. The first clamping link 40 has a large end 48 with a hole 50 defined therethrough and a small end 52 with a hole 54 defined therethrough. First connector 42 pivotally attaches first clamping link 40 to the first support flange 16 by passing through the hole 50 in the large end 48 of the clamping link 40 and engaging a threaded hole 56 in the first support flange 16. The second clamping link 44 likewise has a large end 58 with a hole 60 defined therethrough and a small end 62 with a hole 64 defined therethrough. The second connector 46 pivotally attaches the second clamping link 44 to the second support flange 18 by passing through the hole 60 in the large end and engaging a threaded hole 66 in the second support flange 18. The first connector 42 and second connector 46 define a first pivot axis 68. Therefore, first and second clamping links 40 and 44 pivot around the first pivot axis 68. The first pivot axis 68 and the support axis 34 are parallel and separated by a short distance.

A first intermediate link 80 and a second intermediate link 90 interconnect the small ends 52 and 62 of the clamping links 40 and 44 with the intermediate connection hole 25 on the operating arm 20. The intermediate links 80 and 90 are pivotally attached on opposite sides of the operating arm 20 so that the operating arm 20 is disposed between the first and second intermediate links 80 and 90. First intermediate link 80 has a first end 82 with a hole 84 defined therethrough and a second end 86 with a hole 88 defined therethrough. The second intermediate link 90 has a first end 92 with a hole 94 defined therethrough and a second end 96 with a hole 98 defined therethrough. The first end 82 of the first intermediate link 80 and the first end 92 of the second intermediate link 90 are pivotally connected to the small ends 52 and 62 of the clamping links 40 and 44 by a dowel pin 104. Dowel pin 104 passes through hole 64, hole 94, hole 84, and hole 54. The second end 86 of the first intermediate link 80 is pivotally connected to the intermediate connection hole 25 in operating arm 20 by a first fastener 100 which passes through hole 82 and engages intermediate connection hole 25 in the operating arm 20. Likewise, the second end 96 of the second intermediate link 90 is pivotally connected to the other side of the intermediate connection hole 25 in the operating arm 20 by a second fastener 102 that passes through hole 98 and engages intermediate connection hole 25 in the operating arm 20. The first fastener 100 and the second fastener 102 define an attachment axis 106. The dowel pin 104 defines a second pivot axis 108.

The various elements of the toggle clamp 10 are arranged so that they do not interfere with one another. The operating arm 20 takes the central position between first and second support flanges 16 and 18. Intermediate links 80 and 90 are outboard of the operating arm 20 and therefore in line with the support flanges 16 and 18. However, the shape of these support flanges 16 and 18 and the positions of the intermediate links 80 and 90 prevent an interference. The clamping links 40 and 44 are outboard of the intermediate links 80 and 90 as well as outboard of the support flanges 16 and 18. It is this inside-out arrangement of parts comprising the linkage which provides for a rigid clamping action, and the flexibility of design which provides for outboard clamping links in a manual toggle clamp.

A clamping arm 110 can be connected to the clamping links 40 and 44 for movement therewith. The clamping arm can be of various designs and may connect to both clamping links 40 and 44 or to one or the other clamping link. Alternatively, a first clamping arm can be connected to first clamping link 40 and a second clamping arm connected to second clamping link 44.

Figure 2:
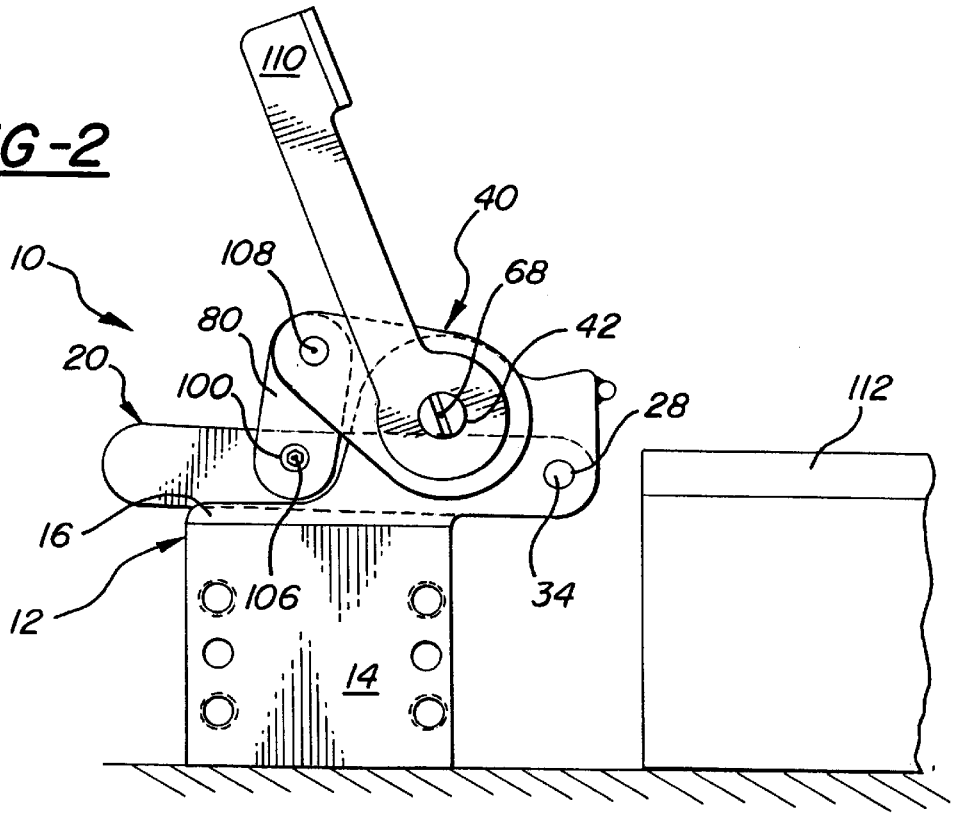
FIG. 2 is a elevational side view of the toggle clamp of FIG. 1 with the operating arm in the first position.
Figure 3:
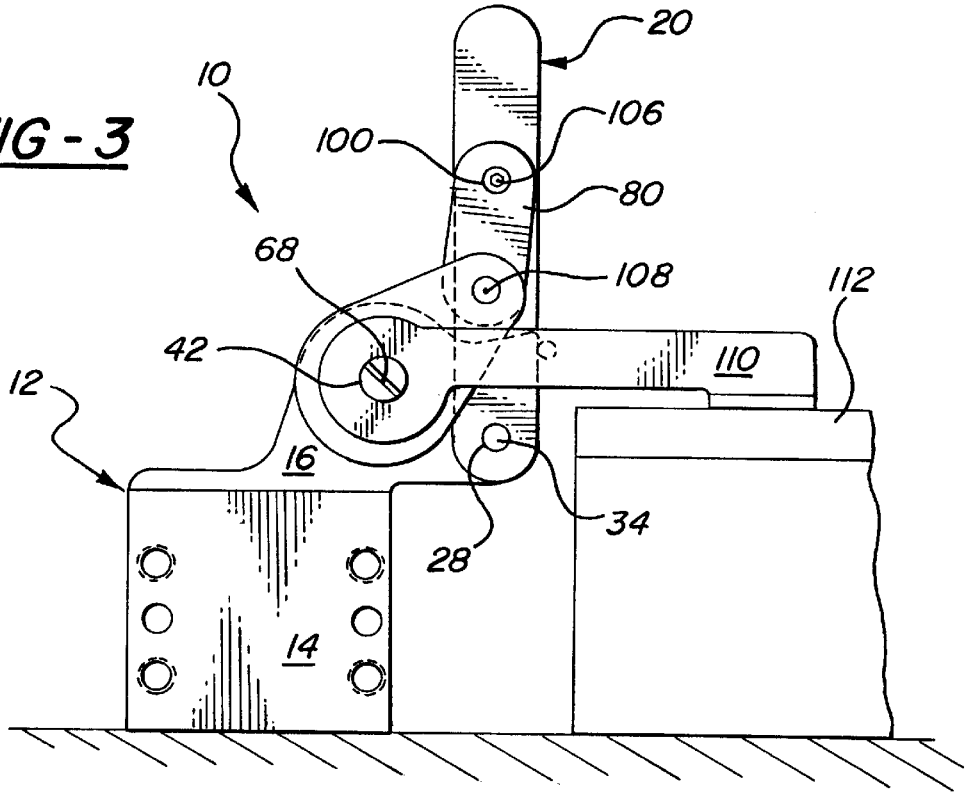
FIG. 3 is an elevational side view of the clamp of FIG. 1 with the operating arm in the second position.

In the use of the clamp, the operating arm 20 is pivoted between a first position as shown in FIG. 2 and a second position as shown in FIG. 3. As the operating arm 20 is moved from the first position to the second position the intermediate links 80 and 90 communicate the movement of the operating arm 20 to the small ends 52 and 62 of the clamping links 40 and 44. Therefore, by moving the operating arm 20 the clamping links 40 and 44 are forced to move. As the operating arm 20 is moved from the first position to the second position, the clamping arm 110, which is connected to the links 40 and 44, is forced to move from an opened position as shown in FIG. 2 to a clamped position as shown in FIG. 3. In the clamped position, the clamping arm 110 presses on a workpiece 112 thereby retaining the workpiece 112.

The support axis 34, the attachment axis 106 and the second pivot axis 108 are parallel but separated by a distance. The support axis 34, the attachment axis 106, and the second pivot axis 108 are not in mutual linear alignment when the operating arm is in the first position as shown in FIG. 2 or the second position as shown in FIG. 3. However, they are in mutual linear alignment when the operating arm is in a third position between the first and second positions. Preferably, the third position is located where the operating arm has gone at least 80% of the distance from the first position to the second position. As best shown in FIG. 3, this arrangement of axes 34, 106, and 108 gives the toggle clamp 10 an "over-center" linkage. This arrangement, locks the clamping arm 110 in the clamped position when the operating arm 20 is in the second position as shown in FIG. 3. Because the support axis 34, the attachment axis 106, and the second pivot axis 108 are not in mutual linear alignment when the clamp is in its clamping position, as shown in FIG. 3, an upward force on the clamping arm 110 cannot move the operating arm 20 out of the second position.

The clamping links 40 and 44 are preferably pear shaped with one end larger than the other. This configuration is preferred because it creates a large area for interconnection between the clamping arm 110 and the clamping links 40 and 44. However, other configurations and shapes of clamping links can be used depending on the application. Also, the relative lengths, shapes and ratios of the operating arm, intermediate links, clamping links and support block can be varied while retaining the over-center linkage characteristics of the present invention. Depending on the application, the ratios may be altered to increase the amount of over-center or change the relative motions of the operating arm and the clamping arm. The support block, the operating arm, the intermediate links, and the clamping links, as well as the connectors, fasteners, and dowel pins, are preferably made of metal. Metal provides high strength and stiffness, good machinability, and reasonable cost. Alternatively, any of the components could be made from plastic, composites, or any material with sufficient strength and rigidity.

In the embodiment shown, the clamping arm 110 connects to the clamping links 40 and 44. Alternatively, the clamping links and the clamping arm could be formed as one integral piece.

In view of the teaching presented herein, other modifications and variations of the present invention will be readily apparent to those of skill in the art. The foregoing drawings, discussion, and description are illustrative of embodiments of the present invention; but are not meant to be limitations on the practice thereof. It is the following claims, including all equivalents, which define the scope of the invention.

I claim:

1. A toggle clamp assembly comprising:

a support block including two spaced apart flanges;

an operating arm having a first end which is pivotally supported by said support block, through a support axis, so as to be pivotable from a first position to a second position, said operating arm being pivotally supported between said spaced apart flanges;

a first and a second intermediate link, each being pivotally attached to said operating arm, on opposite sides thereof through an attachment axis, so that said operating arm is disposed between said first and second intermediate links;

a first and a second clamping link, each clamping link being pivotally supported upon said support block through a first pivot axis, and each clamping link being pivotally connected to a respective one of said intermediate links through a second pivot axis; said toggle clamp assembly being further configured so that the support axis, attachment axis and second pivot axis are not in mutual linear alignment when said operating arm is in said first position or said second position, but are in mutual linear alignment when said operating arm is in a third position between said first position and said second position.

2. The toggle clamp assembly of claim 1, further including a clamping arm which is supported by at least one of said clamping links.

3. The toggle clamp assembly of claim 2, wherein said clamping arm is integral with one of said clamping links.

4. The toggle clamp of claim 1, wherein said support axis, said attachment axis, and said second pivot axis are in mutual linear alignment at said third position after said operating arm has gone at least 80% of the distance from said first position to said second position.

5. The toggle clamp of claim 1, wherein said intermediate links and said operating arm are disposed between said first and second clamping links.

6. A toggle clamp assembly comprising:

a support block including two spaced apart flanges;

an operating arm having a first end which is pivotally supported by said support block, through a support axis, so as to be pivotable from a first position to a second position, said operating arm being pivotally supported between said spaced apart flanges;

a first and a second intermediate link, each being pivotally attached to said operating arm, on opposite sides thereof through an attachment axis, so that said operating arm is disposed between said first and second intermediate links;

a first and a second clamping link, each clamping link being pivotally supported upon said support block through a first pivot axis, and each clamping link being pivotally connected to a respective one of said intermediate links through a second pivot axis, said first clamping link being supported by a first one of said spaced apart flanges and said second clamping link being supported by a second one of said spaced apart flanges; said toggle clamp assembly being further configured so that the support axis, attachment axis and second pivot axis are not in mutual linear alignment when said operating arm is in said first position or said second position, but are in mutual linear alignment when said operating arm is in a third position between said first position and said second position.

7. The toggle clamp assembly of claim 6, further including a clamping arm which is supported by at least one of said clamping links.

8. The toggle clamp assembly of claim 7, wherein said clamping arm is integral with one of said clamping links.

9. The toggle clamp of claim 6, wherein said support axis, said attachment axis, and said second pivot axis are in mutual linear alignment at said third position after said operating arm has gone at least 80% of the distance from said first position to said second position.

10. The toggle clamp of claim 6, wherein said intermediate links and said operating arm are disposed between said first and second clamping links.

* * * * *